United States Patent [19]

Reba

[11] 4,279,610

[45] Jul. 21, 1981

[54] CROSS-LAPPED WEB FORMING SYSTEM

[75] Inventor: Imants Reba, Vancouver, Wash.

[73] Assignee: Crown Zellerbach Corporation, San Francisco, Calif.

[21] Appl. No.: 86,858

[22] Filed: Oct. 22, 1979

[51] Int. Cl.[3] ..... B65H 29/46; B65H 45/20

[52] U.S. Cl. ..... 493/411; 270/30

[58] Field of Search ..... 270/61 F, 79, 69, 73, 270/39; 493/411

[56] References Cited

U.S. PATENT DOCUMENTS

| | | | |
|---|---|---|---|
| 3,219,202 | 11/1965 | Huffman | 270/79 |
| 3,602,494 | 8/1971 | Holmes | 270/79 |
| 3,759,507 | 9/1973 | Imbrecht | 270/79 |
| 3,854,917 | 12/1974 | McKinney | 270/69 |

*Primary Examiner*—Edgar S. Burr
*Assistant Examiner*—A. Heinz
*Attorney, Agent, or Firm*—Thomas R. Lampe

[57] ABSTRACT

A system for forming a layered, cross-lapped web from web material having a predetermined width comprising conveyor means having a web support surface and moveable in a predetermined direction, cross-lapping means moveable relative to the conveyor means and adapted to fold the web material and deliver it to the web support surface to form a layered cross-lapped web on the conveyor means, and means disposed adjacent to the conveyor means web support surface and a web material fold adapted to induce a suction against the web material to position the fold at a predetermined location relative to the conveyor web support surface.

5 Claims, 3 Drawing Figures

CROSS-LAPPED WEB FORMING SYSTEM

BACKGROUND OF THE INVENTION

It is well known in the art to form a wide web from much narrower web material through the use of a layering, cross-lapping process wherein the cross-lapping is done by a roll system travelling back and forth at right angles across a moveable belt which conveys the cross-lapped layered web to a downstream work location whereat the cross layered web material is needle punched or otherwise secured together to form an integral web. As the rolls of such systems reach the end of their travel relative to the web conveyor, the web material is dropped to form a fold and the rolls reverse direction to bring the web material to the opposite edge of the conveyor belt whereat roll travel is again reversed and another fold is dropped onto the belt. So that the final web has a uniform width and even edge it is necessary that the folds be neatly disposed in a straight line and it has been the practice to station an operator at each side of the conveyor belt to manually manipulate the folds and straighten them out. This is not only an extremely boring activity for the operators, but it also makes manufacturing processes of this type relatively labor intensive.

It is an object of the present invention to provide a system for forming a layered, cross-lapped web from web material of the general afore-described type wherein proper positioning of the folds is accomplished by inducing a suction against the web material to position the folds at the desired locations on the conveyor belt and in a desired orientation relative to the direction of movement of the conveyor belt.

SUMMARY

The present invention includes conveyor means having a web support surface and moveable in a predetermined direction. Cross-lapping means is disposed above the conveyor means and adapted to fold web material and deliver it to the web support surface to form a layered cross-lapped web on the conveyor means. On each side of the conveyor means a pair of Coanda nozzles are disposed, said nozzles being spaced from one another at distance substantially equal to the width of the web material. The nozzles of each pair of Coanda nozzles are oriented with respect to one another and with respect to the web material so as to induce a suction against the web material in directions tending to laterally spread the web material and straighten it along its line of fold. Additional Coanda nozzles are preferably provided to maintain the folds in position on the conveyor belt as it is transported thereby to a downstream work station where the web material is needle punched or otherwise secured together to form an integral web.

BRIEF DESCRIPTION OF THE DRAWINGS

The preferred embodiment of the present invention is illustrated in the accompanying drawings in which.

GENERAL DESCRIPTION

Figure 1:
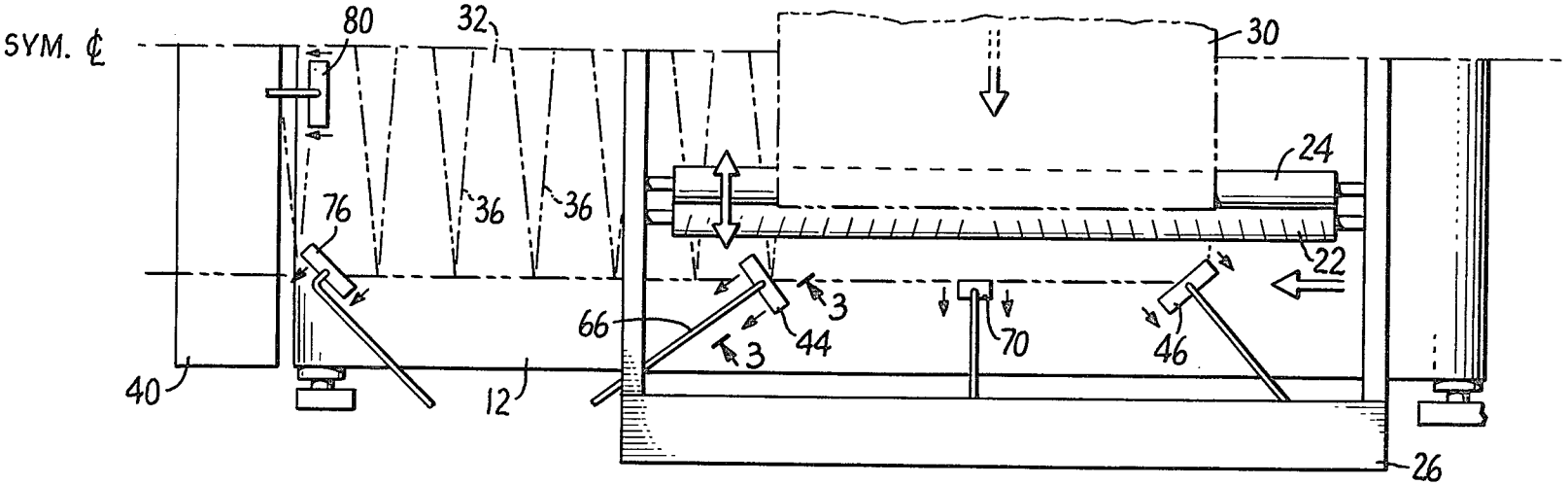
FIG. 1 is a schematic plan view, partially broken away, illustrating apparatus constructed in accordance with the teachings of the present invention.
Figure 2:
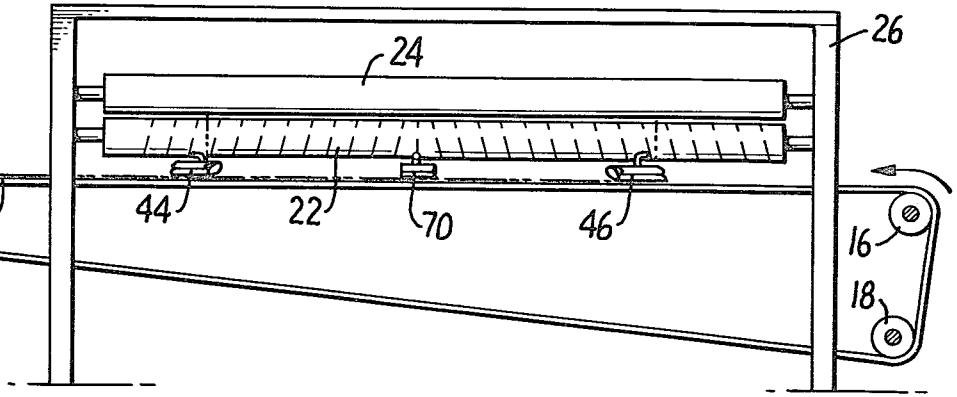
FIG. 2 is a schematic side view of the apparatus.

Referring now to FIGS. 1 and 2, the apparatus of the present invention includes an endless conveyor belt 12 constructed of any suitable material which is looped about rollers 14, 16 and 18, at least one of which is connected to a prime mover means (not shown) to transport the belt in the direction of the arrow, i.e. in a counter clockwise direction as viewed in FIG. 2. Disposed above conveyor belt 12 are a pair of lapping rolls 22 and 24 operatively associated with and mounted on lapping table or frame 26. Through a suitable conventional mechanism (not shown) the rotating lapping rolls 22 and 24 reciprocally move as a pair back and forth above the web support surface of conveyor belt 12 at right angles to the direction of movement of the conveyor belt web support surface.

Disposed between lapping rolls 22 and 24 is web material 30 which is delivered from a parent roll (not shown) to be cross-lapped and layered upon the web support surface of conveyor belt 12 to form a web of predetermined width and basis weight. This is accomplished by the reciprocal movement of rotating lapping rolls 22 and 24 which deliver the web material back and forth onto the web support surface of the moveable conveyor and form folds in the web material as the lapping rolls reach the end of each reciprocal path of movement near each edge of the conveyor belt 12. The lapping rolls 22 and 24 make several passes across the conveyor belt before the conveyor belt itself has moved a distance equal to the width of web material 30. In this manner, a multi-ply web 32 is formed. Phantom lines are used to illustrate the web material laps incorporated in the completed web and are identified by reference numeral 36. The conveyor belt 12 delivers layered, cross-lapped web 32 to a needle punch or other suitable device 40 utilized to secure the layers of the web 32 together.

The aforedescribed structure per se is known in the art and for this reason has not been described in detail. It is readily apparent that to create a web 32 of uniform width, precise positioning of the folds of web material 30 on conveyor belt 12 must be accomplished. In an arrangement of the type described it has been the practice to station an operator near the edges of the conveyor belt 12 near the location where lapping roll movement terminates and the folds are made. To provide for a neatly folded edge, each operator grabs the fold as it is formed and straightens it out, either by hand or with an implement. This is not only an extremely boring activity for the operators, but it also makes the process labor intensive as well. In addition, the desired uniformity in web width is not always obtained using these manual techniques.

In the present invention Coanda nozzles are utilized to position the folds of the web material. Specifically, a pair of Coanda nozzles 44 and 46 are provided near the edge of conveyor belt 12 in the manner illustrated. Coanda nozzles 44 and 46 are spaced from one another a distance substantially equal to the width of web material 30. In addition, nozzles 44 and 46 are oriented substantially 90 degrees with respect to one another, or approximately 45 degrees relative to the direction of movement of conveyor belt 12.

Figure 3:
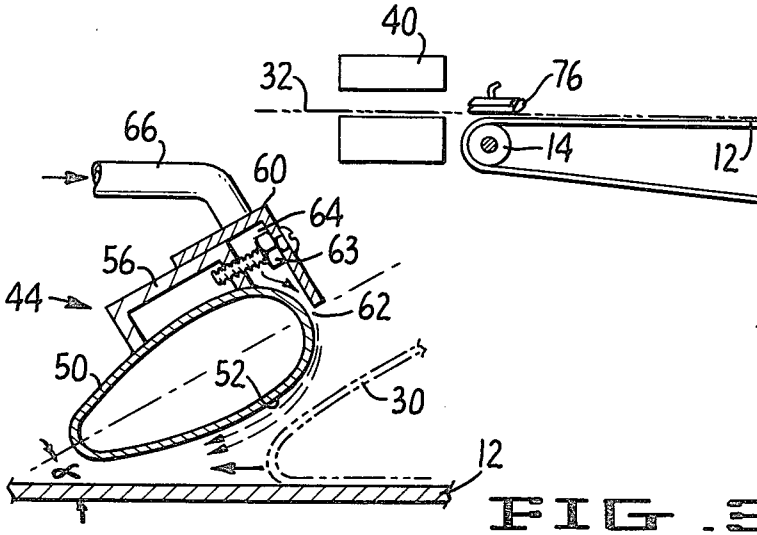
FIG. 3 is an enlarged cross-sectional view taken along line 3—3 of FIG. 1.

FIG. 3 illustrates the construction of nozzle 44. It will be appreciated that the same construction is utilized for the other nozzles employed in the system. Coanda nozzle 44, as disclosed, is what is known in the art as a two-dimensional Coanda nozzle. While any suitable two-dimensional Coanda nozzle may be utilized to practice the teachings of the present invention, the illustrated form is preferred because it may be readily constructed from "off the shelf" components. Nozzle 44 includes a foil element 50 having a generally smoothly curved fluid flow attachment surface 52. Attached to foil element 50, as by means of intermediate structural element 56, is an L-shaped member 60 which extends along the full length of foil element 50. The downwardly extending leg of L-shaped member 60 forms a restricted opening in the form of a slit 62. End walls, only one of which, end wall 64, is illustrated, form a closed chamber with which slit 62 is in fluid flow communication. If desired, means may be provided for adjusting the width of slit 62. For example, a screw and lock nut arrangement such as that indicated by reference numeral 63 may be employed for this purpose.

A conduit 66 is connected to L-shaped member 60 and the interior of conduit 66 is in fluid flow communication with the chamber. Conduit 66 is connected at its other end to a source of compressed air (not shown) whereby the nozzle chamber may be pressurized and the flow of a thin layer of compressed air induced downwardly through slit 62. Due to the Coanda effect, the flow of compressed air will attach itself to fluid flow attachment surface 52 and proceed in the direction of the arrows. At the same time, movement of the high speed pressurized air causes the entrainment of ambient atmospheric air and causes same to move in the same general direction. When the web fold is positioned in the immediate vicinity of the Coanda nozzle 44 as shown in phantom in FIG. 3 it too will be entrained by the suction created due to the Coanda effect. It is preferred that the nozzle be positioned so that the primary axis of its foil element will form an angle $\alpha$ with the conveyor belt web support surface falling within the range of about 20° to about 40°.

Because Coanda nozzles 44 and 46 are oriented at approximately 45° degrees to the direction of movement of conveyor belt 12, when the fold of web material 30 is simultaneously entrained by nozzles 44 and 46, entrainment and suction generated thereby grab the corners of the disposited web material pulling them under the nozzles and toward the edge of the conveyor belt 12. Simultaneous lateral spreading of the web material fold is also produced so that the fold extends between the nozzles in a straight line. Since nozzles 44 and 46 are in alignment with the direction of movement of conveyor belt 12, the fold will also be so aligned.

A third Coanda nozzle 70 is preferably positioned along the web material fold line between the nozzles 44 and 46 of the pair of nozzles. While nozzles 44 and 46 are preferably in the order of 12 inches long to provide a sufficient flow area over the edge of the web material, nozzle 70 may be only half as long since it is used solely for the purpose of web fold guidance. Nozzle 70 is preferrably positioned so that its pressurized air exit slit barely touches the edge of the web fold. Suction generated by this nozzle pulls the fold down and guides it while it travels to the left as shown in FIGS. 1 and 2.

A fourth Coanda nozzle 76 is positioned at the end of conveyor belt 12 at the inlet of needle punch 40. Nozzle 76, being disposed at approximately 45 degrees to the web edge, guides and presses down the corners of the folds as they enter the needling apparatus. The length of nozzle 76 preferably approximates that of nozzles 44 and 46. In the case of wide webs it may also be desirable to dispose yet additional Coanda nozzles along the web width at the conveyor end to keep the web flat overall prior to entering the needle punch. One such nozzle 80, disposed at right angles to the direction of web movement, is illustrated.

The degree to which the nozzles are pressurized depends upon such factors as slit size, web material basis weight, etc. For most applications it has been found that satisfactory results will be obtained using a nozzle slit width of 0.002 inches, with the nozzles being operated at approximately 15–20 psig supply pressure. This corresponds to a compressed air consumption of 18–20 SCFM per foot of nozzle length.

While the arrangement disclosed may be operated with the nozzles under continuous pressure, the use of pilot operated valves on nozzles 46 and 70, and possibly nozzle 44 also, may be desireable to minimize air consumption. Air flow to these nozzles would be turned on just before the approach of the oncoming lap and turned off a short time later through a conveniently suitable switch arrrangement activated for example by the position and movement of lapping rolls 22 and 24.

It is of course to be understood that four Coanda nozzles are operatively associated with the other edge of conveyor belt 12 that has been broken away and not illustrated for purposes of convenience and simplicity.

I claim:

1. In apparatus for forming a layered, cross-lapped web from web material having a predetermined width, said apparatus including conveyor means having a web support surface and moveable in a predetermined direction and cross-lapping means disposed above said conveyor means and reciprocally moveable transverse to said predetermined direction across said conveyor means for folding said web material along fold lines extending across the width thereof in said predetermined direction and positioning a folded, layered cross-lapped web formed from said web material on said conveyor means web support surface, the improvement comprising at least a pair of Coanda nozzles positioned over said conveyor means web support surface, said pair of nozzles being disposed along at least one of the fold lines extending in said predetermined direction and spaced from one another a distance substantially equal to said web material width, each of said nozzles including an elongated foil element defining a generally smoothly curved fluid flow attachment surface and means defining a restricted opening for directing fluid under pressure to said fluid flow attachment surface whereby said fluid will attach to said surface and flow along said surface, each of said pair of nozzles having the elongated foil element thereof angularly oriented with respect to one another and with respect to said predetermined direction to create divergent fluid flows, said cross-lapping means delivering said web material to said nozzles with said fold line extending between said nozzles in said predetermined direction and said divergent fluid flows laterally spreading said web material to its full width along said fold line.

2. The apparatus of claim 1 wherein the elongated foil elements of the nozzles of said pair of Coanda nozzles are oriented substantially 90 degrees with respect to one another and wherein said divergent fluid flows are directed approximately 45 degrees to said line of fold.

3. The apparatus of claim 1 further comprising means for securing said web material together to form an integral web and a Coanda nozzle positioned along said fold line between said securing means and said pair of Coanda nozzles.

4. The apparatus of claim 1 wherein the foil element of each nozzle of said pair of nozzles has a primary axis, said primary axis being disposed at an angle relative to said web support surface in the range of from about 20° to about 40° and the suction induced by fluid flowing along the fluid flow attachment surface defined thereby pulls said web material toward said web support surface.

5. The apparatus of claim 1 wherein said conveyor means has a discharge end and wherein said apparatus further comprises at least one Coanda nozzle disposed at the discharge end of the conveyor means and oriented at right angles to said predetermined direction.

* * * * *